US005976194A

United States Patent [19]

Franzén

[11] Patent Number: 5,976,194

[45] **Date of Patent: *Nov. 2, 1999**

[54] METHOD AND MEANS FOR CLEANING

[75] Inventor: Hans Franzén, Nykōping, Sweden

[73] Assignee: Silk & Clean International AB, Nykoping, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/944,259

[22] Filed: Oct. 6, 1997

Related U.S. Application Data

[63] Continuation of application No. 08/495,590, filed as application No. PCT/SE94/00023, Jan. 14, 1994, abandoned.

[30] Foreign Application Priority Data

Jan. 15, 1993 [SE] Sweden ..... 9300088

[51] Int. Cl.[6] ..... C11D 17/04; A47L 25/08; D06L 1/04; D06L 1/02

[52] U.S. Cl. ..... 8/142; 8/137; 510/285; 510/281; 510/282; 510/283; 510/292; 510/295; 510/297; 510/523

[58] Field of Search ..... 8/142, 137; 510/285, 510/281, 282, 283, 292, 295, 297, 523

[56] References Cited

U.S. PATENT DOCUMENTS

| | | | |
|---|---|---|---|
| 3,549,545 | 12/1970 | Stolmeijer | 8/142 |
| 3,907,496 | 9/1975 | Neel et al. | 8/142 |
| 5,238,587 | 8/1993 | Smith et al. | 510/277 |

FOREIGN PATENT DOCUMENTS

| | | |
|---|---|---|
| 429172 | 5/1991 | European Pat. Off. . |
| 2467239 | 4/1981 | France . |
| 2004511 | 8/1971 | Germany . |
| 2708931 | 9/1978 | Germany . |

*Primary Examiner*—Alan Diamond
*Attorney, Agent, or Firm*—Hodgson, Russ, Andrews, Woods & Goodyear LLP

[57] ABSTRACT

A method and means for cleaning silk fabric for the prompt and efficient removal of stains from silk fabric, for example a stain on a silk tie, without causing visible lasting changes in color and without unpleasant smell. By means of a cleaning tissue, made of, for example, a textile material, essentially in the form of a wet tissue, impregnated with a grease solvent and a neutralizing agent, a stain on a silk tie is easily removed without any traces by rubbing the stain with the tissue, whereby the stain is dissolved by the grease solvent and is absorbed by the tissue, the smell-neutralizing agent preventing any unpleasant smell from spreading. The grease solvent may be a special boiling point spirit of heptane type. The smell-neutralizing agent may be an oil of terpene type, such as lemon oil.

3 Claims, No Drawings

METHOD AND MEANS FOR CLEANING

This is a continuation of application Ser. No. 08/495,590 filed on Mar. 4, 1996 now abandoned, which is a 371 of International Application PCT/SE94/00023 filed on Jan. 14, 1994 and which designated the U.S.

TECHNICAL FIELD

The preset invention relates to a method and a means for cleaning textile fabric, preferably silk fabric.

PRIOR ART

When a high-quality, expensive fabric such as silk fabric used in, for example, ties gets soiled, it is often difficult to remove any stains without leaving visible traces of the cleaning agent used, which stains may appear on the fabric in the form of rings or darkened areas. Further, to remove the stains cleaning agents are often used, the strong or pungent smell of which may be very disrturbing to the environment.

SUMMARY OF THE INVENTION

For the prompt and efficient removal of stains from silk fabric, for example a stain on a silk tie, without causing lasting visible changes in color and without unpleasant smell, there has been developed a novel method and means for cleaning silk fabric which entireley meet the requirements as to promptness, efficiency, and invisibility without bad smell. By means of a small cleaning tissue in an airtight package, which cleaning tissue is made of, for example, a paper material, essentially in the form of a wet tissue impregnated with a grease solvent and a smell-neutralizing agent, a stain on a silk tie is easily removed without any traces. When a stain on a tie is discovered, the package is opened, the impregnated cleaning tissue is taken out, and the stain is then rubbed with the tissue, whereby the stain is dissolved by the grease solvent and is absorbed by the tissue, the smell-neutralizing agent preventing unpleasant smell from spreading. The grease solvent may be a hydrocarbon, such as a special boiling point spirit of heptane type. The smell-neutralizing agent may be an oil of terpene type, such as lemon oil.

DESCRIPTION OF AN EMBODIMENT AND HANDLING THEREOF

For the prompt and efficient removal of stains from silk fabric, for example, a stain on a silk tie, a small cleaning tissue has been impregnated with a grease solvent, such as special boiling point spirit of heptane type to which a smell-neutralizing agent, such as lemon oil, has been added at a ratio of 4 ml:1 l of heptane. The impregnated cleaning tissue is enclosed in an airtight package, in the same way as a commercially available wet tissue. On opening of the package, the cleaning tissue may be taken out and used directly. The stain is then rubbed with the cleaning tissue, whereby the stain is dissolved by the grease solvent, is spread in the tissue and is absorbed by the same, in increasingly wide circles to prevent the occurrence of "rings" on evaporation of the heptane. The additive will neutralize any unpleasant smell in connection with the cleaning as well as thereafter. After use, when the stain has been removed, the cleaning tissue may be discarded in therefor intended place.

I claim:

1. A method of wet cleaning fabric, comprising silk fabric, for the removal of stains, consisting essentially of the steps of impregnating a cleaning tissue with a grease solvent comprising heptane to which a smell-neutralizing agent comprising lemon oil has been added, the volume ratio of heptane to lemon oil being approximately 1000:4, enclosing the cleaning tissue in an airtight package, on the occurrence of stains opening the package and taking out said impregnated cleaning tissue, manually rubbing the stain with the impregnated tissue for dissolving the stain by the grease solvent and spreading the stain in the tissue and neutralizing any smell by operation of the smell-neutralizing agent, and discarding the tissue after the stain is removed by said step of rubbing the stain.

2. A method according to claim 1 wherein said step of manually rubbing the stain with the impregnated tissue is performed under ambient temperature conditions.

3. A means for wet cleaning of fabric, comprising silk fabric, for the removal of stains, consisting essentially of a cleaning tissue impregnated with a grease solvent consisting essentially of heptane to which a smell-neutralizing agent consisting essentially of lemon oil has been added for manually rubbing the stains and an airtight package for enclosing the cleaning tissue before use, the volume ratio of heptane to lemon oil being approximately 1000:4, said package being openable to enable said tissue to be taken out for rubbing the stain to dissolve the stain whereupon the tissue is discarded after the stain is removed.

* * * * *